US005941258A

United States Patent [19]

Flenniken et al.

[11] Patent Number: 5,941,258

[45] Date of Patent: Aug. 24, 1999

[54] LONG REACH, CABLE-SUSPENDED CLEANING APPARATUS FOR BUILDING DISPOSAL CHUTES AND METHOD

[75] Inventors: Charles Flenniken, 4436 120th Ave. North, Royal Palm Bch., Fla. 33411; Robert G. Johnston, Coconut Creek, Fla.

[73] Assignee: Charles Flenniken, Royal Palm Beach, Fla.

[21] Appl. No.: 08/826,296

[22] Filed: Mar. 27, 1997

Related U.S. Application Data

[63] Continuation-in-part of application No. 08/513,176, Aug. 9, 1995, abandoned.

[51] Int. Cl.[6] ..... B08B 9/00

[52] U.S. Cl. ..... 134/22.12; 134/168 R; 134/174

[58] Field of Search ..... 134/167 R, 168 R, 134/168 C, 172, 174, 198, 22.1, 22.12; 15/104.062, 104.05

[56] References Cited

U.S. PATENT DOCUMENTS

| | | | |
|---|---|---|---|
| 3,994,310 | 11/1976 | Brandon | 134/167 C |
| 4,071,919 | 2/1978 | Fields et al. | 15/21 R |
| 5,038,810 | 8/1991 | Pacheco et al. | 134/167 C |
| 5,444,887 | 8/1995 | Rufolo | 15/104.31 |
| 5,638,844 | 6/1997 | Szekeres | 134/167 C |

*Primary Examiner*—Jeffrey Snay
*Attorney, Agent, or Firm*—Frank L. Kubler

[57] ABSTRACT

An apparatus for cleaning a disposal chute in a building, the chute having a chute wall, includes a crane and cable assembly; a cleaning fluid spraying assembly suspended from the crane and cable assembly for lowering and raising within the chute; a flexible fluid delivery line suspended from the spraying assembly; and a fluid pump assembly connected to the flexible fluid delivery line. The spraying assembly preferably additionally includes a guide cage having resilient and outwardly bowed vertical support ribs interconnected by lateral support hoops extending substantially parallel to the mounting plate. The apparatus preferably additionally includes at least one cage wheel having an axial wheel port and being rotatably mounted on at least one support hoop for rolling against the chute wall as the spraying assembly is raised and lowered within the chute. A method is provided of cleaning a building disposal chute with the above described apparatus including the steps of securing a cleaning fluid spray head from a cable; lowering and raising the spray head from a crane assembly within a disposal chute; and delivering cleaning fluid to the spray head from the spray head lower end through a fluid line extending downwardly within the chute to a fluid pump assembly.

7 Claims, 7 Drawing Sheets

10
40
290
204
294
292
270
14
176
170
150
100
22
24
176
20
30
30
296
70
298
12

LONG REACH, CABLE-SUSPENDED CLEANING APPARATUS FOR BUILDING DISPOSAL CHUTES AND METHOD

FILING HISTORY

This application is a continuation-in-part of application Ser. No. 08/513,176, filed on Aug. 9, 1995, now abandoned.

BACKGROUND OF THE INVENTION

1. Field of the Invention

The present invention relates generally to the field of cleaning devices for disposal chutes in buildings. More specifically the present invention relates to a rotating head water spraying assembly lowered into a disposal chute on a cable deployed from a portable crane, the spraying assembly receiving water through a flexible water line suspended within the chute from the spraying assembly and connected to a high power water pump and pump drive engine mounted on a truck parked at the base of the chute.

The spraying assembly includes a mounting plate, at least one water line coupler connected to and extending below the lower face of the mounting plate, a water delivery manifold and spray head rotatably mounted to a bearing structure secured to the upper face of the plate and in fluid communication with the water line through a port in the plate. These elements are mounted within a guide cage having lateral wheels for rolling against chute walls during raising and lowering of the spraying assembly and including a hook connection structure such as a ring for securing to the cable.

2. Description of the Prior Art

There previously have been cleaning devices for disposal chutes in buildings. It is recognized that garbage disposal chutes in particular, if left uncleaned, can become serious health hazards to building occupants. Recent literature on the subject has termed these buildings "sick buildings". The prior cleaning devices have generally included a water spray head suspended from a water delivery hose which is wound and unwound and deployed downwardly from a spool through an upper floor chute access hatch. Water is delivered into the hose from a pump and pump motor on the floor from which the hose is deployed. A problem with these prior devices has been that they have a reach limited to perhaps ten floors because the weight of the deployed hose and spray head place the hose at risk of failure in tension at greater lengths. As a result, in tall buildings, the hose must be rewound and the spray head retrieved after cleaning only a fraction of the entire chute length, the water pump and pump motor must be moved to another floor and the hose and spraying assembly lowered once again to clean another limited chute segment. This stage by stage process consumes many man-hours and makes chute cleaning prohibitively costly. Another problem is that, since the water pump must be located on the upper floor from which the hose is unwound, the reach is also limited in a practical way by the size of the water pump and pump station supplying the spray head. The requirement that the water pump be transportable to and from an upper building floor, and from floor to floor, severely limits the pump and power plant size. A pump and pump motor large enough to maintain high water pressure to a spray head through a hose extending dozens of floors below would be too heavy and cumbersome to carry to an upper floor.

One such prior device is disclosed in Fields, et al., U.S. Pat. No. 4,071,919 issued on Feb. 7, 1978 for a waste chute cleaning apparatus. Fields, et al., is designed for a square cross-section chimney and would not operate properly in the standard circular cross-section waste disposal chutes. The Fields, et al. spray head spins at only between ten and two hundred revolutions per minute. A rotating spray head is disclosed in Brandon, U.S. Pat. No. 3,994,310 issued on Nov. 30, 1976.

It is thus an object of the present invention to provide a building disposal chute cleaning apparatus which can suitably clean a chute extending down through at least sixty-five floors in a single lowering without danger of structural failure and spray head disconnection, for maximum cleaning in minimal working time.

It is another object of the present invention to provide such an apparatus which receives water from a large capacity pump and pump power plant positioned at the ground floor of a building and delivering water through a vertical line hundreds of feet in extended length, so that the pump and power plant do not need to be carried to an upper floor of the building. This permits the present inventive spray head to spin at a speed in excess of four thousand revolutions per minute and to produce in excess of five thousand pounds per square inch of water pressure.

It is still another object of the present invention to provide such an apparatus which includes a spray head guide structure for smooth and unobstructed spray head movement through a waste-caked chute, in both horizontal and vertical chute directions.

It is finally an object of the present invention to provide such an apparatus is highly durable and relatively inexpensive to manufacture.

SUMMARY OF THE INVENTION

The present invention accomplishes the above-stated objectives, as well as others, as may be determined by a fair reading and interpretation of the entire specification.

An apparatus is provided for cleaning a disposal chute in a building, the chute having a chute wall, including a crane and cable assembly; a cleaning fluid spraying assembly suspended from the crane and cable assembly for lowering and raising within the chute; a flexible fluid delivery line suspended from the spraying assembly; and a fluid pump assembly connected to the flexible fluid delivery line.

The spraying assembly preferably includes a mounting structure; a first fluid line coupler mounted to the mounting structure; a bearing structure secured to the mounting structure; a fluid delivery manifold rotatably mounted to the bearing structure; and a spray head in fluid communication with and mounted to the fluid delivery manifold to rotate together with the fluid delivery manifold and being in fluid communication with the fluid line. The spraying assembly preferably additionally includes a guide cage having resilient and outwardly bowed vertical support ribs interconnected by lateral support hoops extending substantially parallel to the mounting plate. The apparatus preferably additionally includes at least one cage wheel having an axial wheel port and being rotatably mounted on at least one support hoop for rolling against the chute wall as the spraying assembly is raised and lowered within the chute.

An apparatus is further provided for cleaning a disposal chute in a building, the chute having a chute wall, including a crane assembly; a cleaning fluid spraying assembly suspended from the crane assembly for lowering and raising within the chute; including a guide cage having a guide cage frame structure; a flexible fluid delivery line suspended from the spraying assembly; a fluid pump assembly connected to the flexible fluid delivery line; and at least one cage wheel rotatably mounted on the guide cage frame structure for rolling against the chute wall as the spraying assembly is raised and lowered within the chute. The guide cage frame structure preferably includes several resilient and outwardly bowed vertical support ribs interconnected by lateral support hoops; where the at least one cage wheel has an axial wheel port and is rotatably mounted on at least one of the support hoops.

A method is provided of cleaning a building disposal chute with the above described apparatus including the steps of securing a cleaning fluid spray head from a cable; lowering and raising the spray head from a crane assembly within a disposal chute; and delivering fluid to the spray head from the spray head lower end through a fluid line extending downwardly within the chute to a fluid pump assembly.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
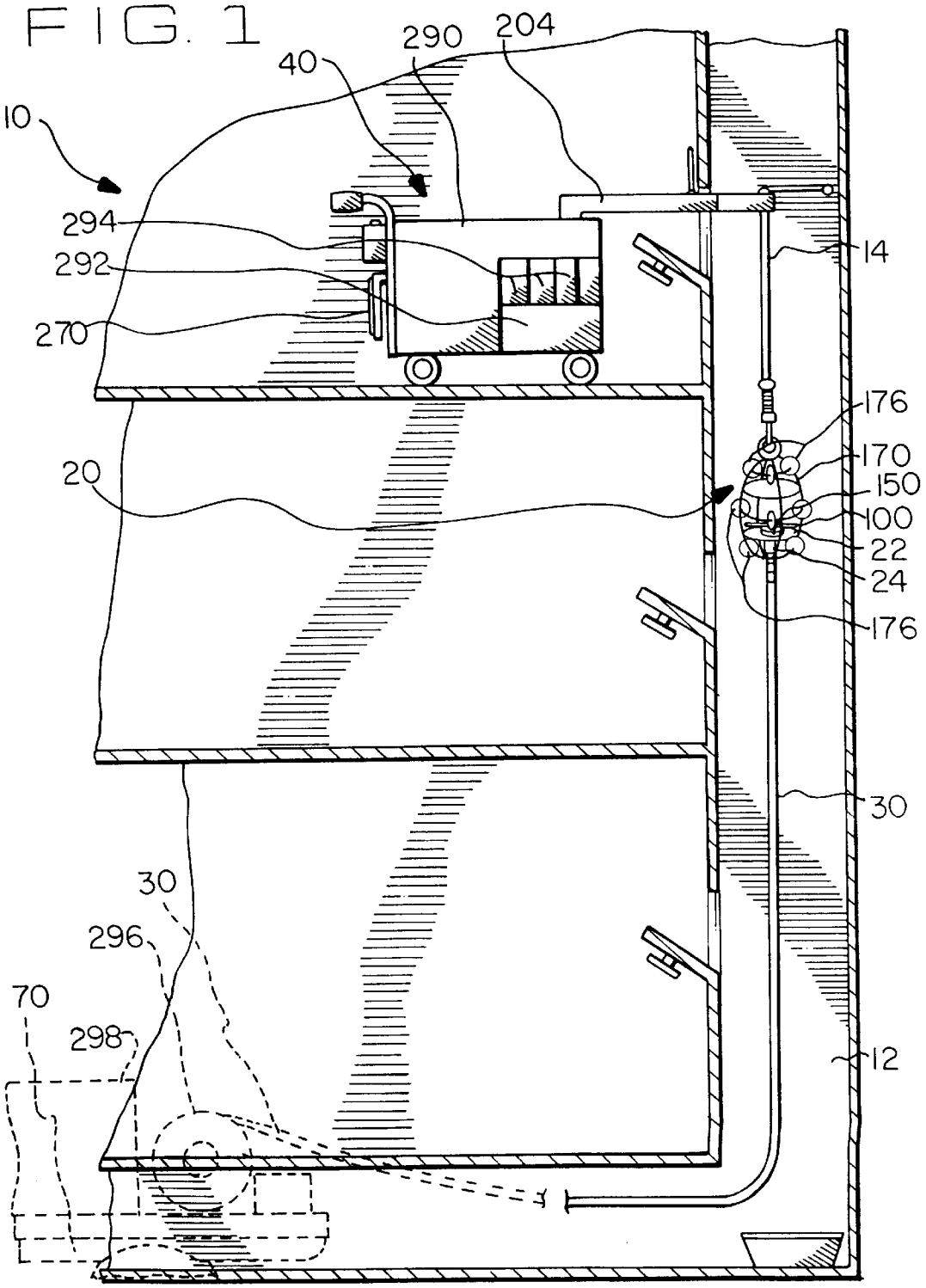
FIG. 1 is a cross-sectional side view of a building and building chute being cleaned with the inventive apparatus. The crane cart is shown on an upper floor, the crane arm extending into a chute access hatch and lowering the spraying assembly down the chute. The van and the water line extending from the van to the spraying assembly are also illustrated.
Figure 3:
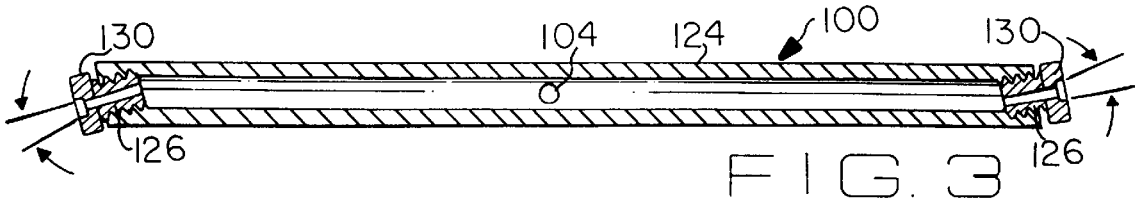
FIG. 3 is a cross-sectional top view of the spray head only, showing the angled spray tips to cause spray head rotation.
Figure 2:
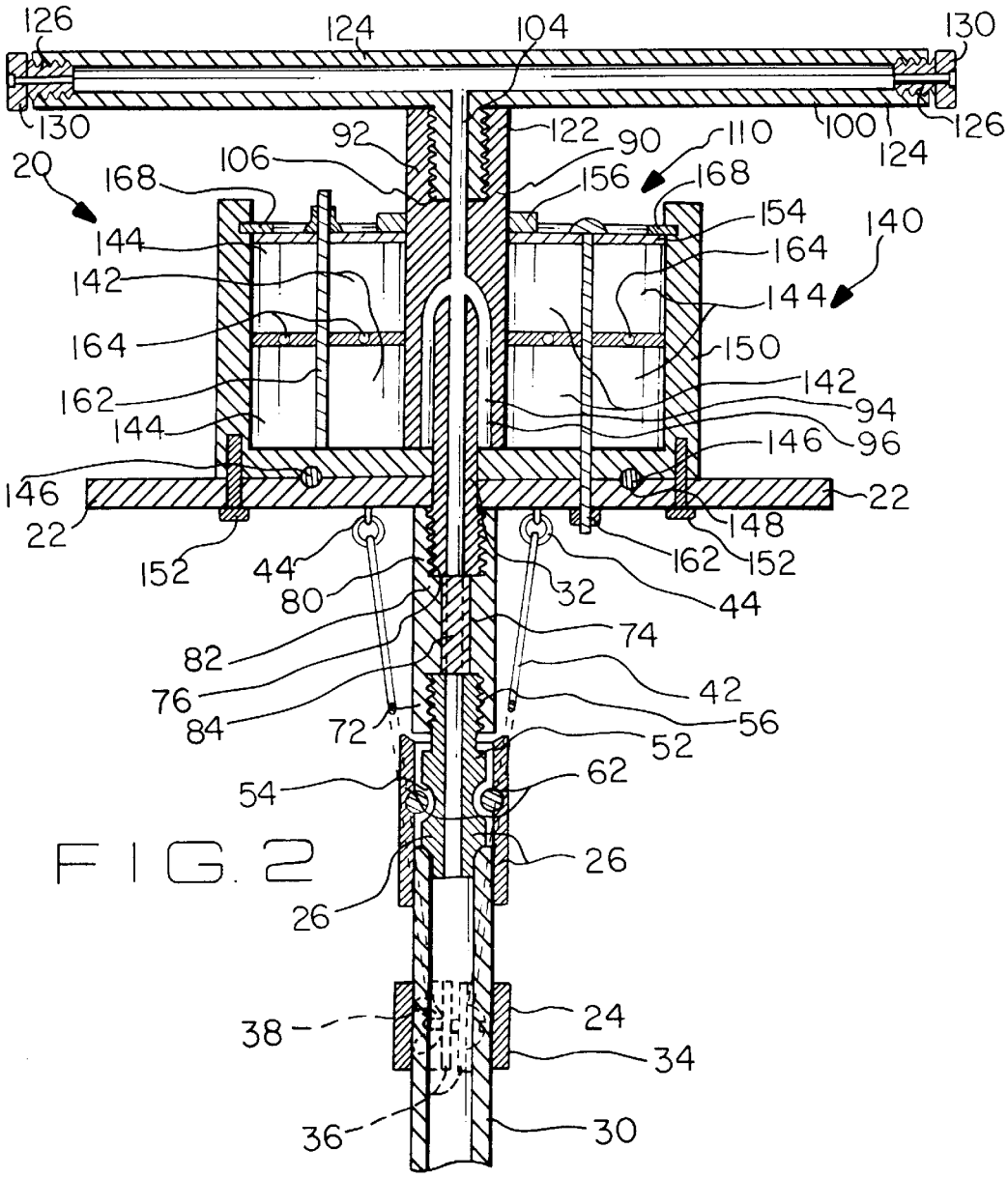
FIG. 2 is a cross-sectional side view of the spraying assembly without the guide cage.
Figure 4:
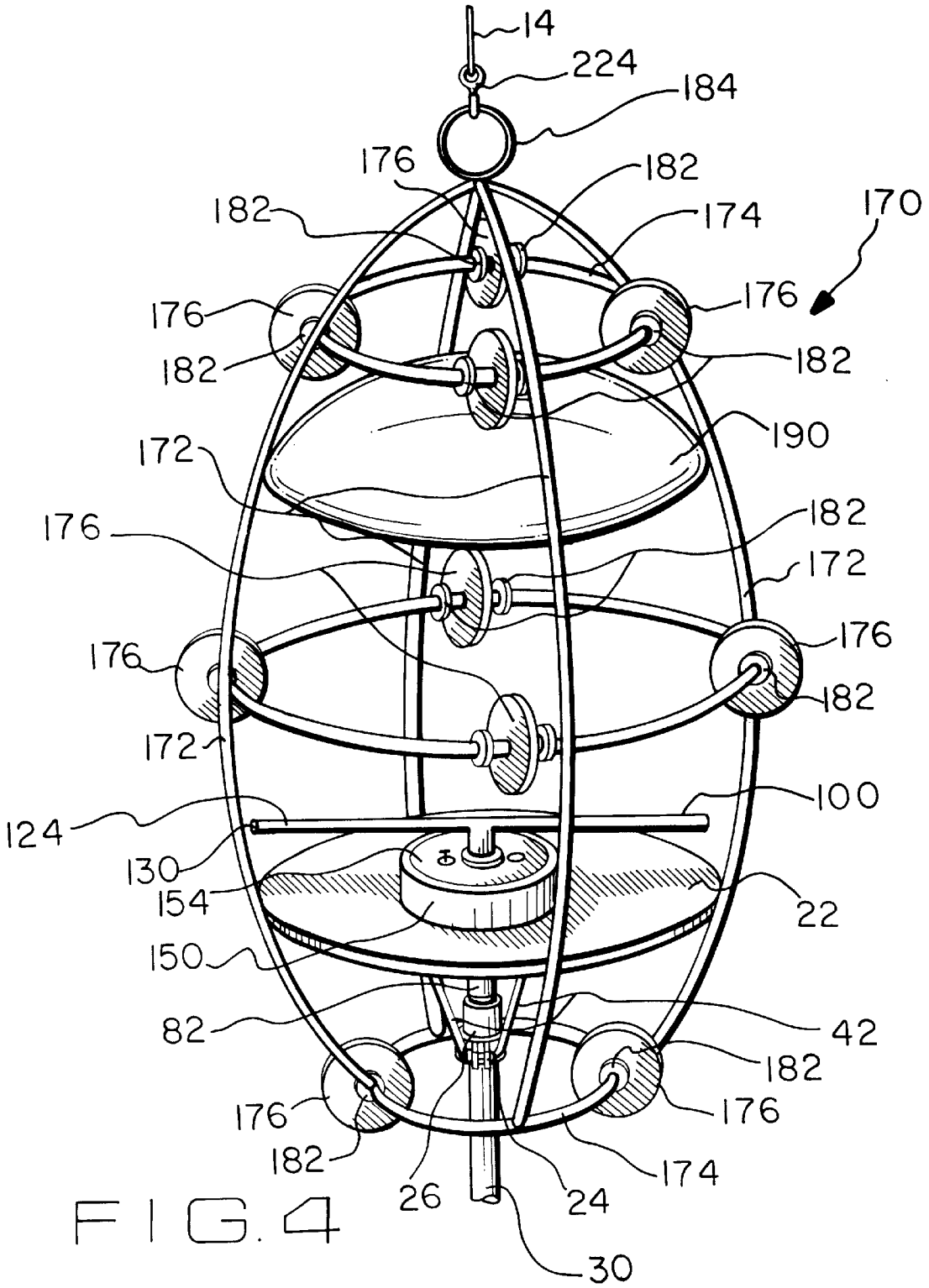
FIG. 4 is a perspective view of the entire spraying assembly and guide cage.
Figure 5:
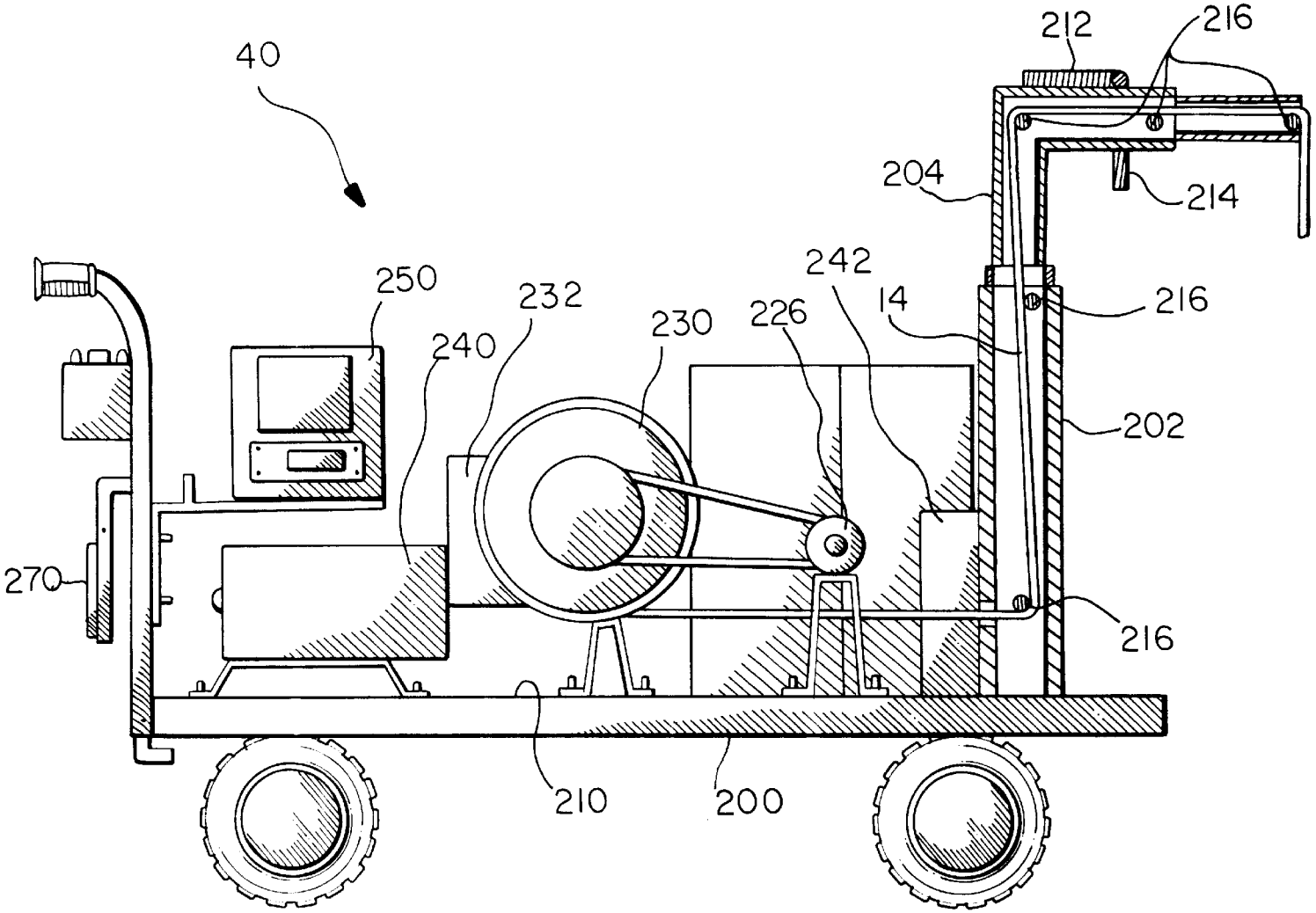
FIG. 5 is a side view of the crane cart and elements mounted on the cart deck.
Figure 6:
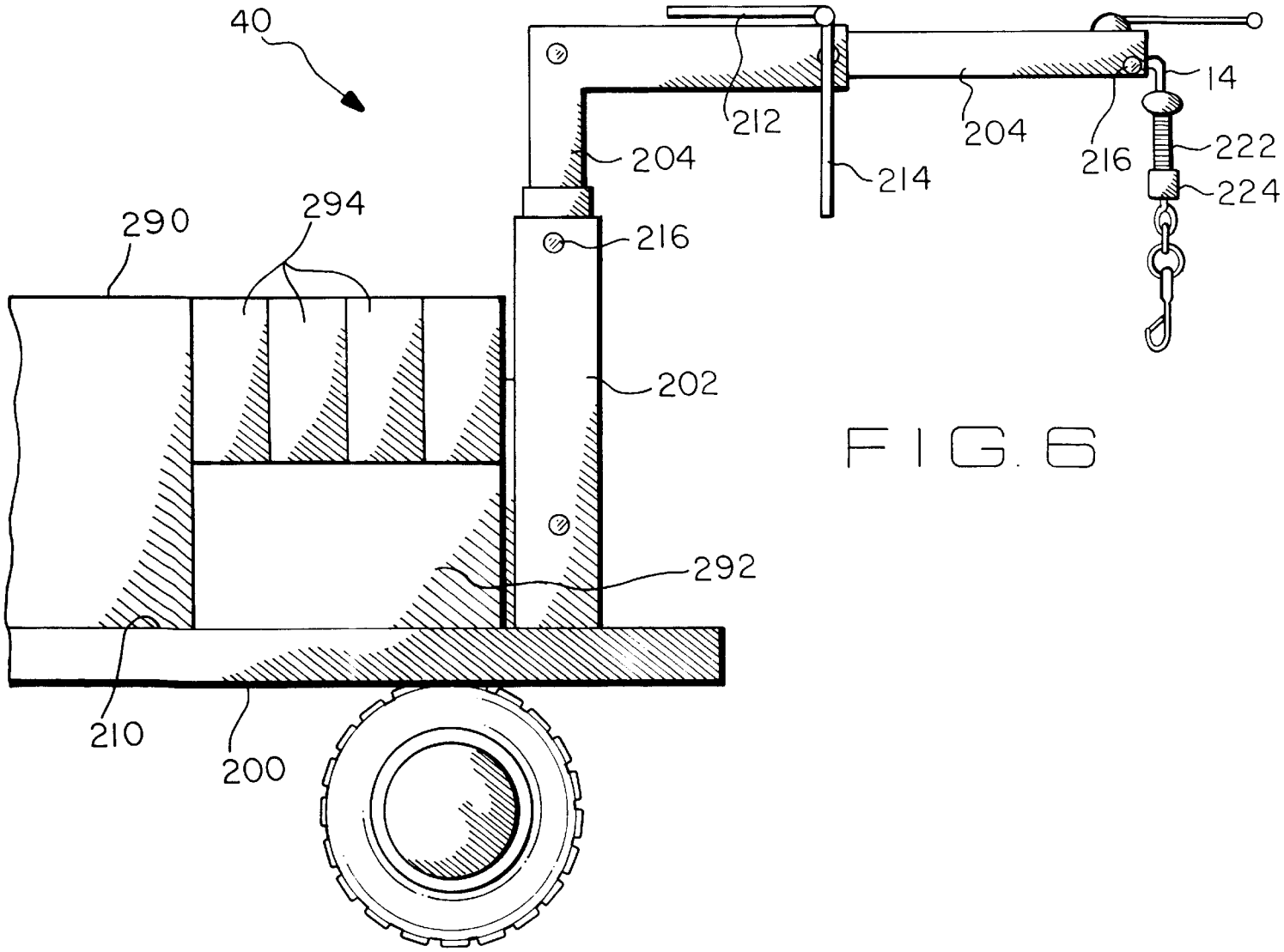
FIG. 6 is a view as in FIG. 5, better showing the crane arm and also showing the cart housing in place, complete with tool and other compartments.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–8, a cleaning apparatus 10 for a building disposal chute 12 is disclosed. Apparatus 10 includes a rotating head spraying assembly 20 for a cleaning fluid such as water suspended from a cable 14 and lowered into a disposal chute 12 from a crane assembly 40, spraying assembly 20 receiving water through a flexible hose water line 30 suspended from assembly 20 and connected to a water pump assembly 60 mounted on a truck 70 at the base of chute 12. To provide points of reference for discussion, it is assumed that spraying assembly 20 is suspended in a vertical orientation from cable 14.

Spraying assembly 20 includes a mounting plate 22, a first water line coupler 24 and a redundant second water line coupler 26, both connected to an suspended beneath mounted to the lower face of mounting plate 22. See FIG. 2. Mounting plate 22 is preferably a metal disk having a central plate port 32. First water line coupler 24 preferably takes the conventional form of two semi-annular clamping members 34 which fit around opposing sides of water line 30. Each clamping member 34 has lateral flanges 36 with fastener openings through which fasteners 38 interconnect members 34, and pull members 34 into tight, high friction contact around line 30. Members 34 are connected to mounting plate 22 by metal straps 42. Straps 42 are secured to clamping members 34 by the fasteners 38 and are secured to mounting plate 22 by plate fasteners 44 which are preferably divided into portions which rotate relative to each other to permit straps 42 to swivel during shifting water line 30 loading. Water line 30 not only extends between clamping members 34 but also extends beyond them toward plate 22. Between first water line coupler 24 and mounting plate 22 is second water line coupler 26, also of conventional design. Second water line coupler 26 includes a tubular inner fitting 52 having an outer surface with a circumferential groove 54 which fits snugly into the water line 30. Tubular inner fitting 52 includes a threaded segment 56 extending beyond the end of water line 30 toward plate 22. Coupler 26 further includes a tubular outer fitting 62 which fits snugly around water line 30 and includes recessed ball bearings (not shown) which bear laterally against water line 30 adjacent to the circumferential groove 54 and push the water line 30 wall into circumferential groove 54 to create both a water tight seal and a snug line 30 engagement.

Tubular inner fitting threaded segment 56 screws into a first end 72 of an internally threaded tubular filter housing 74. An externally threaded end 76 of a water manifold core tube 80 screws into a second end 82 of filter housing 74, and extends through central plate port 32 and above plate 22. Between the inserted ends of tubular inner fitting threaded segment 56 and water manifold tube threaded end 76 is a removable and replaceable water filter 84.

A water delivery manifold 90 and spray head 100 are rotatably mounted to a bearing structure 110 secured to the upper face of mounting plate 22. Water manifold core tube 80, as its name suggests, forms the core of water delivery manifold 90. A rotating outer tube 92 is provided having a wide internal segment 94 which fits around manifold core tube 80 to define an annular space 96 between outer tube 92 and manifold core tube 80. A narrow internal segment 104 extends within outer tube 92 away from plate 22 to the remote end of outer tube 92 where narrow internal segment 104 widens slightly and contains internal threads 106. Rotating spray head 100 includes a T-shaped tube structure having an externally threaded base tube segment 122 which screws into threaded narrow internal segment 104 and two opposing arm segments 124. Arm segments 124 each have an outermost passageway portion 126 which is oriented parallel to mounting plate 22 and angled several degrees (theta) from the arm segment longitudinal axis in opposing directions, so that water exiting arm segments 124 propels spray head 100 angularly to cause spray head 100 rotation. See FIG. 3. The preferred angle from the longitudinal axis is five degrees, although many other angles are suitable. Each outermost passageway portion 126 is internally threaded and receives an externally threaded spray nozzle 130 of generally conventional nozzle design.

Rotating outer tube 92 is press fitted into two laterally abutting standard ball bearing structures 140, each having an inner spindle 142 which rotates with outer tube 92 and an outer ring 144 which remains fixed with respect to plate 22. Outer rings 144 of bearing structures 140 are fitted within a cup-shaped outer shell 150 which is anchored to mounting plate 22 with bolts 152. An O-ring 146 is seated in a circular groove 148 between outer shell 150 and plate 22. Bearing structures 140 are retained within tubular outer shell 150 by a grease retaining plate 154 and a nylon grommet 156. Grease receiving fittings 162 and grease passageway 164 are provided within bearing structures 140, and all are secured in place with a snap ring 168.

Spraying assembly 20 further includes a guide cage 170 having resilient and outwardly bowed vertical support ribs 172 interconnected by lateral support hoops 174 extending substantially parallel to mounting plate 22. Support ribs 172 and hoops 174 are preferably welded together where they cross each other. Cage wheels 176 having axial wheel ports (not shown) are rotatably mounted periodically around hoops 174 and roll against the walls of chute 12 as spraying assembly 20 is raised and lowered. Anchor washers 182 are preferably welded to hoops 174 on either side of each wheel 176 to retain the wheel 176 in its position along the hoop 174. Support ribs 172 converge and join at the cage 170 upper end, and a cage lifting ring 184 is welded to support ribs 172 at this point. A concave splash guard plate 190 is welded between support ribs 172 above spray head 100 and parallel to hoops 174.

The crane assembly 40 preferably includes a wheeled cart 200 having an upwardly directed hollow post 202 welded to its cart deck 210 and a hollow, L-shaped, telescoping crane arm 204 which fits into post 202. See FIGS. 5–8. Telescoping crane arm 204 includes horizontal and vertical planar splash and steam guards 212 and 214, respectively. The crane cable 14 extends through the interior of telescoping crane arm 204 and post 202 over rotatably mounted cable guide pins 216. At the free end of cable 14 is a compression safety spring 222 and a swivel and safety hook assembly 224 of conventional design. Telescoping crane arm 204 is preferably rotatable 360 degrees within post 202 so that crane arm 204 can be swung over cart 200 during crane assembly 40 transport and storage. Cable 14 exits a port in post 202 and extends over the cart deck 210 to a level winder mechanism 226 and then to a cable spool 230. Level winder mechanism 226 feeds cable 14 back and forth across the spool 230 as cable 14 is wound onto spool 230 for subsequent tangle-free release, and is of known design. Cable spool 230 is mounted on a spool axle which extends into a gear reduction box 232 which is driven by a crane motor 240. A video receiver 242 is preferably provided as part of crane assembly 40, is mounted on crane deck 210, and is preferably wireless. Cage 170 can be removed from cable 14 and replaced with a remote control video camera (not shown) which transmits its wireless signal to receiver 242, from which the signal is fed to a video monitor and control system 250 also mounted on cart deck 210.

Figure 7:
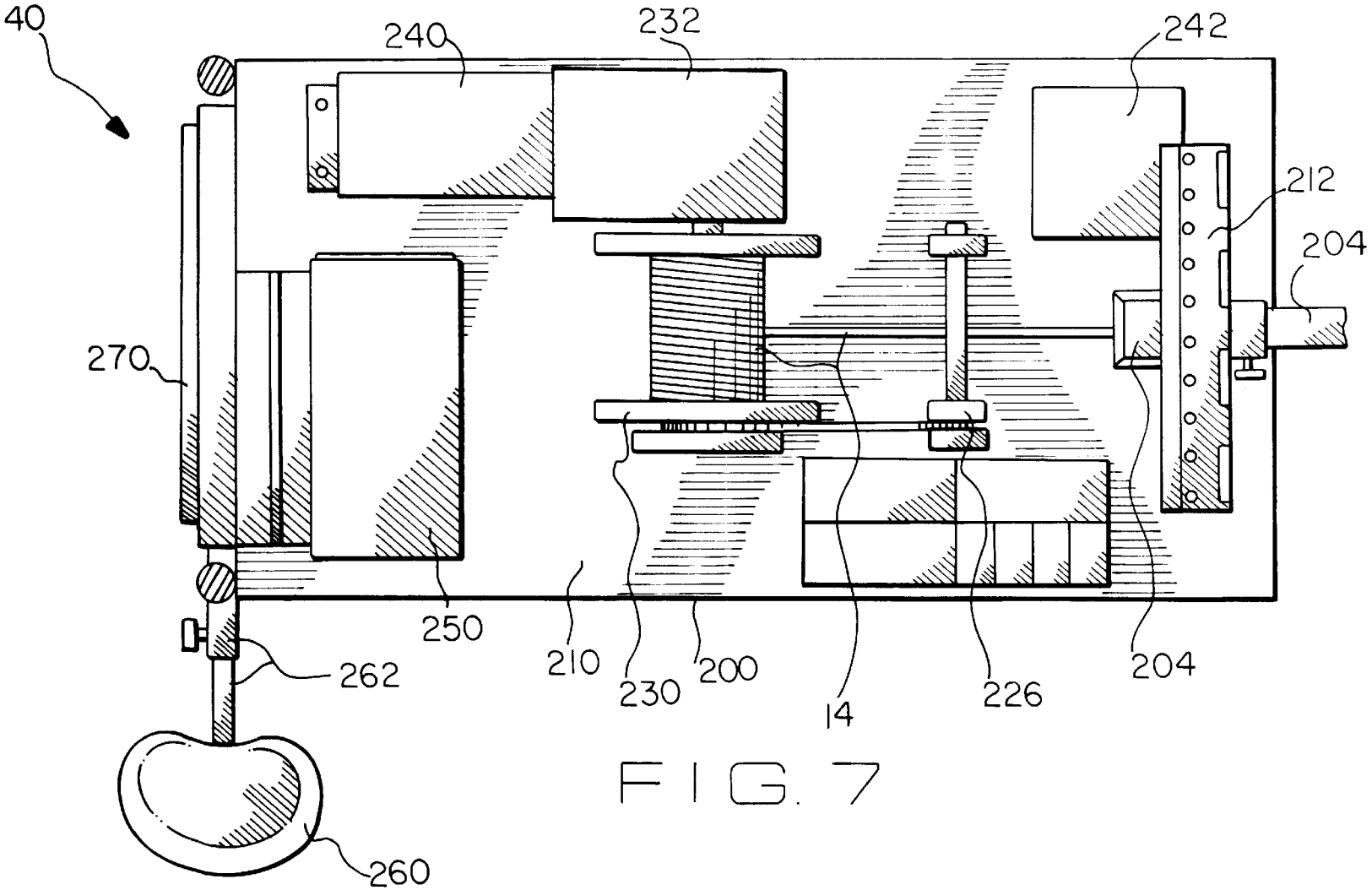
FIG. 7 is a top view of the cart.
Figure 8:
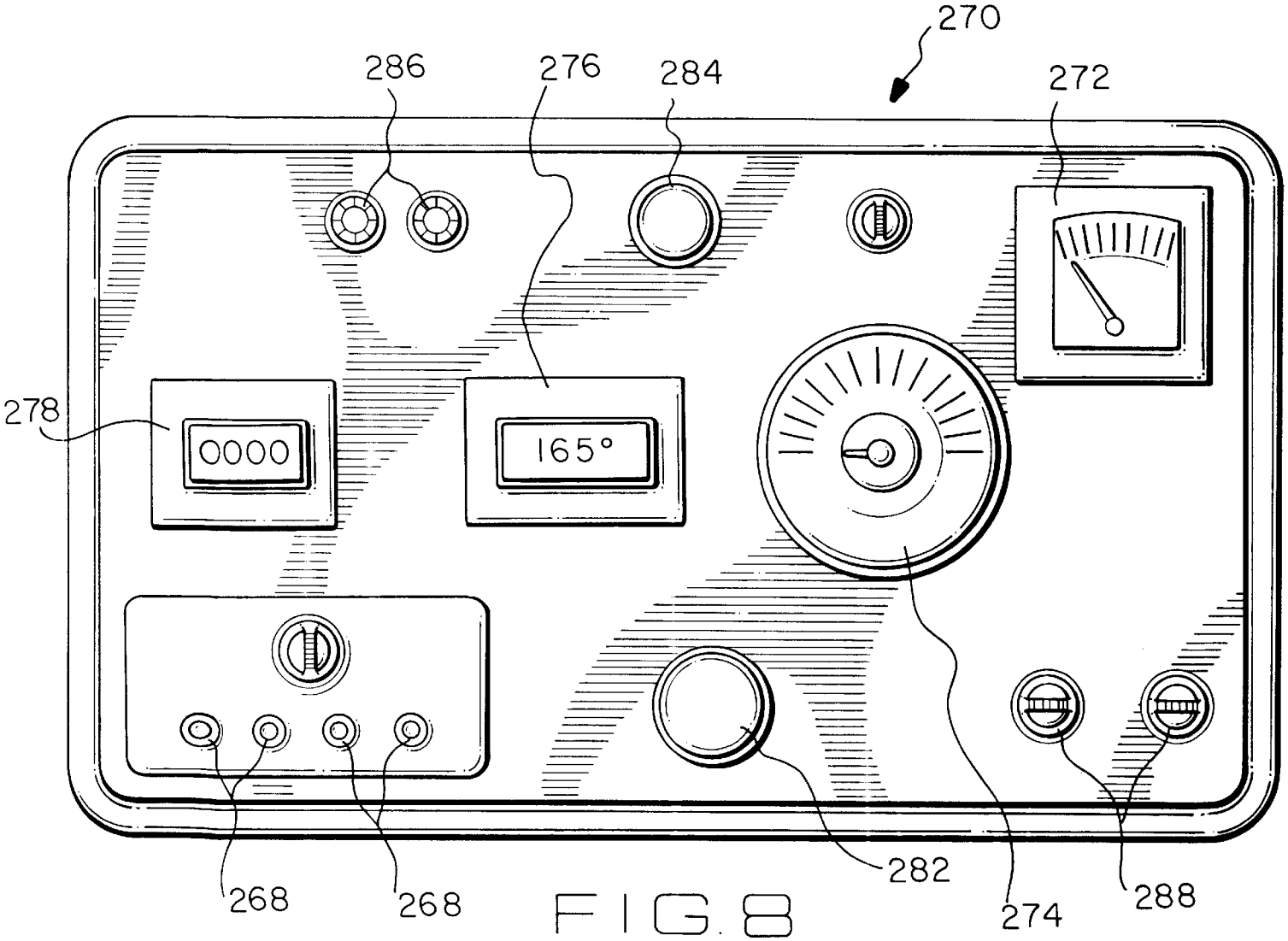
FIG. 8 is a front view of the control panel.

A pressure-activated operator seat 260 is provided on a pivoting seat arm 262. When the operator rises off seat 260, the seat senses the loss of weight and stops cable spool 230 from rotating, for safety purposes. An override switch (not shown) is preferably provided, however, for instances in which this shut off feature is not appropriate. Seat arm 262 protrudes from the end of cart 200 opposite telescoping crane arm 204 so that the operator helps counterbalance the weight of the deployed cable 14, water line 30 and guide cage 170. A crane control panel 270 is also provided, as shown in FIGS. 7 and 8. Control panel 270 includes an amp meter shut down control 272 shutting down the crane motor 240 in the event of electrical overload. Also provided are audio, video and antenna jacks 268, a velocity control dial 274, a chute temperature gauge 276, a digital cable extension measure display 278, an emergency stop switch 282, a main power switch 284 and fuses 286. Vertical cable movement control switches 288 are also provided.

An outer cart housing 290 is preferably provided which encloses cable level winder mechanism 226, cable spool 230, gear reduction box 232 and crane motor 240. Recessed into the exterior of cart housing 290 are tool and miscellaneous component compartments 292 and 294, respectively. A exhaust fan (not shown) is preferably provided within cart housing 290 which draws air through a filtered port (not shown) into housing 290 and which exhausts heated air out through an exhaust port (not shown) in housing 290.

Water pump assembly 60 includes a diesel engine power plant and is preferably mounted in a three quarter ton van 70 parked at the base of the chute 12. Water line 30 is wound around a water line dispensing spool 296 and connected to pump assembly 60, which draws water from a water tank 298 on the truck 70 bed.

Method

In practicing the invention, the following method may be used. Securing a water spray head 100 from a cable 14 and lowering and raising spray head 100 from a crane assembly 40 within a disposal chute 12. Another and simultaneous step is that of delivering water to spray head 100 from its lower end through a water line 30 extending downwardly within chute 12 to a water pump assembly 60. All parts of apparatus 10 which can be made of metal are preferably made of stainless steel.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A chute and chute cleaning apparatus comprising:

a building having a vertical disposal chute with a chute wall and at least thirty floors, said floors comprising rooms with doorways, and an upper said floor and a lower said floor each having a chute access port opening through said chute wall;

cart means sized to roll from one said room to another through said doorways;

a crane and cable assembly resting on said cart means and having boom means extending into said chute access port on said upper floor;

a cleaning fluid spraying assembly suspended from said crane and cable assembly for lowering and raising within said chute;

a flexible fluid delivery line suspended from said spraying assembly;

and a fluid pump assembly having at least the capacity to deliver water to the thirtieth floor of said building and connected to said flexible fluid delivery line.

2. The apparatus of claim 1, wherein said spraying assembly comprises:

a mounting structure;

a first fluid line coupler mounted to said mounting structure;

a bearing structure secured to said mounting structure;

a fluid delivery manifold rotatably mounted to said bearing structure;

and a spray head in fluid communication with and mounted to said fluid delivery manifold to rotate together with said fluid delivery manifold and being in fluid communication with said fluid line.

3. The apparatus of claim 1, wherein said spraying assembly additionally comprises:

a guide cage having resilient and outwardly bowed vertical support ribs interconnected by lateral support hoops extending substantially parallel to said mounting plate.

4. The apparatus of claim 3, additionally comprising at least one cage wheel having an axial wheel port and being rotatably mounted on at least one said support hoop for rolling against said chute wall as said spraying assembly is raised and lowered within said chute.

5. A chute and chute cleaning apparatus comprising:

a building having a vertical disposal chute with a chute wall and at least thirty floors, said floors comprising rooms with doorways, and an upper said floor and a lower said floor each having a chute access port opening through said chute wall;

cart means sized to roll from one said room to another through said doorways;

a crane assembly resting on said cart means and having boom means extending into said chute access port on said upper floor;

a cleaning fluid spraying assembly suspended from said crane assembly for lowering and raising within said chute; comprising a guide cage having a guide cage frame structure;

a flexible fluid delivery line suspended from said spraying assembly;

and a fluid pump assembly having at least the capacity to deliver water to the thirtieth floor of said building and connected to said flexible fluid delivery line;

and at least one cage wheel rotatably mounted on said guide cage frame structure for rolling against said chute wall as said spraying assembly is raised and lowered within said chute.

6. The apparatus of claim 5, wherein said guide cage frame structure comprises a plurality of resilient and outwardly bowed vertical support ribs interconnected by lateral support hoops; wherein said at least one cage wheel has an axial wheel port and is rotatably mounted on at least one said support hoop.

7. A method of cleaning a vertical disposal chute within a building having at least thirty floors including an upper said floor and a lower said floor, said floors comprising rooms with doorways, the chute having a chute wall and a chute access port opening through said chute wall at said upper floor and at said lower floor; using a chute cleaning apparatus comprising cart means sized to roll from one said room to another through said doorways; a crane and cable assembly resting on said cart means and having boom means extending into said chute access port on said upper floor; a cleaning fluid spraying assembly suspended from said crane and cable assembly for lowering and raising within said chute; a flexible fluid delivery line suspended from said spraying assembly; and a fluid pump assembly having at least the capacity to deliver water to the thirtieth floor of said building and connected to said flexible fluid delivery line; comprising the steps of:

moving said crane and cable assembly on said cart means into said building and to said upper floor and through one said doorway into one said room;

maneuvering said cart means such that said crane and cable assembly extends into said chute through said chute access port at said upper floor;

extending said flexible fluid delivery line into said chute through said chute access port at said upper floor and down said chute to said chute access port at said lower floor;

positioning said fluid pump assembly substantially adjacent to said chute access port at said lower floor;

connecting said fluid pump assembly to said flexible fluid delivery line through said chute access port at said lower floor;

connecting said flexible fluid delivery line to said cleaning fluid spraying assembly;

inserting said cleaning fluid spraying assembly into said chute through said chute access port at said upper floor and suspending said cleaning fluid spraying assembly from said crane and cable assembly within said chute;

activating said fluid pump assembly to deliver cleaning fluid through said flexible fluid delivery line upwardly to said cleaning fluid spraying assembly;

and lowering said cleaning fluid spraying assembly downwardly into said chute with said crane and cable assembly.

* * * * *